US007526427B2

(12) United States Patent
Kovacevic

(10) Patent No.: US 7,526,427 B2
(45) Date of Patent: Apr. 28, 2009

(54) SYSTEM AND METHOD FOR RECEPTION, PROCESSING AND TRANSMISSION OF DIGITAL AUDIO STREAM

(75) Inventor: Branko D. Kovacevic, Willowdale (CA)

(73) Assignee: ATI Technologies, Inc., Thornhill, Ontario (CA)

( * ) Notice: Subject to any disclaimer, the term of this patent is extended or adjusted under 35 U.S.C. 154(b) by 714 days.

(21) Appl. No.: 09/800,225

(22) Filed: Mar. 6, 2001

(65) Prior Publication Data

US 2002/0128823 A1 Sep. 12, 2002

(51) Int. Cl.
*G10L 21/00* (2006.01)

(52) U.S. Cl. ..... 704/201; 370/218; 370/354

(58) Field of Classification Search ..... 704/500–504; 709/238; 370/395.62, 536, 542, 509, 397, 370/389, 412, 466, 469, 352, 353, 354, 355, 370/357, 218; 375/240.25, 240.26; 379/142.16
See application file for complete search history.

(56) References Cited

U.S. PATENT DOCUMENTS 5,726,989 A * 3/1998 Dokic ..... 370/509
5,835,493 A * 11/1998 Magee et al. ..... 370/395.62
5,841,472 A * 11/1998 Rim et al. ..... 375/240.25
6,076,062 A * 6/2000 Van Steenbrugge ..... 704/500
6,182,146 B1 * 1/2001 Graham-Cumming, Jr. . 709/238
6,236,432 B1 * 5/2001 Lee ..... 375/240.26
6,359,911 B1 * 3/2002 Movshovich et al. ..... 370/536
6,449,352 B1 * 9/2002 Takahashi et al. ..... 379/142.16

OTHER PUBLICATIONS

"Transmission of Non-Telephone Signals," Information Technology—Generic Coding of Moving Pictures and Associated Audio Information: Systems, ITU-T Recommendation H.222.0, Jul. 1995, 120 pp.
"Information Technology—Generic Coding of Moving Pictures and Associated Audio Information—Part 3: Audio," ISO/IEC 13818-3, Second Edition, Apr. 15, 1998, 116 pp.

* cited by examiner

*Primary Examiner*—Huyen X. Vo

(57) ABSTRACT

A system and methods are described for processing digital audio stream data from received transport streams. A transport stream parser identifies particular transport packets related to audio stream data. The transport stream parser enables audio parser and provides packet identifiers of the particular transport packets to the audio parser. The audio parser selects the particular transport packets from a transport stream. The audio parser discards transport packets not related to specific audio types and provides packetized elementary stream audio data to an audio decoding system. The packetized elementary audio stream data is processed into an I2S elementary stream and decoded into pulse-coded modulation (PCM) audio data for output through an external audio receiver, such as through a digital to analog converter. The packetized elementary stream data and I2S elementary stream data are also stored in memory for playback requests generated by the audio decoding system at a later time.

30 Claims, 12 Drawing Sheets

--PRIOR ART--

--PRIOR ART--

--PRIOR ART--

-- PRIOR ART --

MPEG-2 TRANSPORT CORE

| TD_TP_HEADER [RW] 32 bits (access: 32) | | | |
|---|---|---|---|
| **Field Name** | **Bits** | **Default** | **Description** |
| TPH4 | 7:0 | 0x00 | Set to 0 at the start of the transport packet. Set to the fourth byte value after the fourth byte of the transport packet header is parsed. |
| TPH3 | 15:8 | 0x00 | Set to 0 at the start of the transport packet. Set to the third byte value after the third byte of the transport packet header is parsed. |
| TPH2 | 23:16 | 0x00 | Set to 0 at the start of the transport packet. Set to the second byte value after the second byte of the transport packet header is parsed. |
| TPH1 | 31:24 | 0x00 | Set to 0 at the start of the transport packet. Set to packet start code (0x47) after the first byte of the transport packet header is parsed. |

| TD_AF [RW] 32 bits (access: 32) | | | |
|---|---|---|---|
| **Field Name** | **Bits** | **Default** | **Description** |
| AF_LEN | 7:0 | 0x0 | Set to 0 at the start of new transport packet, then to the length of the currently parsed adaptation field, i.e. adaptation_filed_length syntax element. |
| AF_FLAGS | 15:8 | 0x0 | Set to 0 at the start of new transport packet, then to flag byte (second byte) of adaptation field. |
| SPLICE_COUNTDOWN | 23:16 | 0x0 | Set to 0 at the start of new transport packet, then to splice_countdown value of adaptation field. |
| AF_PRIVATE_DATA_LEN | 31:24 | 0x0 | Set to 0 at the start of new transport packet, then to private_data_length value of adaptation field. |

| TD_AF_EXT [RW] 32 bits (access: 32) | | | |
|---|---|---|---|
| **Field Name** | **Bits** | **Default** | **Description** |
| AF_EXT_LEN | 7:0 | 0x00 | Set to 0 at the start of new transport packet, then to the length of extension data of adaptation field. |
| (reserved) | 31:8 | 0 | Unused bit-field, always set to 0. |

| TD_PES [RW] 32 bits (access: 32) | | | |
|---|---|---|---|
| **Field Name** | **Bits** | **Default** | **Description** |
| PES_STREAMID | 7:0 | 0x0 | Set to zero when payload_unit_start_indicator is found as '1', then set to stream_id value extracted from the PES header. 0xE0 – 0xEF for video PES parser, 0xC0 – 0xDF for audio PES parser. |
| PES_FLAGS_B7 | 15:8 | 0x0 | Set to zero when payload_unit_start_indicator is found as '1', then to byte 7 (flags) of PES header. |
| PES_FLAGS_B8 | 23:16 | 0x0 | Set to zero when payload_unit_start_indicator is found as '1', then to byte 8 (flags) of PES header. |
| PES_HEADER_DATA_LEN | 31:24 | 0x0 | Set to zero when payload_unit_start_indicator is found as '1', then to the value of extracted PES_header_length of the current PES header. |

| TD_PES_EXT [RW] 32 bits (access: 32) | | | |
|---|---|---|---|
| **Field Name** | **Bits** | **Default** | **Description** |
| PES_EXT_FLAGS | 7:0 | 0x00 | Set to zero when payload_unit_start_indicator is found as '1', then to the value of extracted flags from the extension of the current PES header. |
| PACK_FIELD_LEN | 15:8 | 0x00 | Set to zero when payload_unit_start_indicator is found as '1', then to the pack_length. |
| PES_EXT_FIELD_LEN | 23:16 | 0x00 | Set to zero when payload_unit_start_indicator is found as '1', then to the length of the PES packet extension data bit-field. |
| (reserved) | 31:24 | 0x00 | Unused bit-field, reads as 0. |

FIG. 7

| TD_PEEK<br>[RW] 32 bits (access: 32) | | | |
|---|---|---|---|
| **Field Name** | **Bits** | **Default** | **Description** |
| TP_PARSED | 0 | '0' | Set to '0' after the current TP packet is parsed<br>Set to '1' after transport packet header is parsed |
| AF_PARSED | 1 | '0' | Set to '0' after the current TP packet is parsed<br>Set to '1' after adaptation field is parsed |
| PES_PARSED | 2 | '0' | Set to '0' after payload_unit_start_indicator is '1'<br>Set to '1' after PES packet is parsed. |
| TP_STATUS | 5:3 | '000' | Current status of the transport packet parser: this 3 bit field codes the status of the latest parsed transport packet (TP):<br><br>'000' – No error<br>'001' – Scrambled TP<br>'010' – Illegal AF flag<br>'011' – Duplicate TP<br>'100' – Illegal AF payload length<br>'101' – Illegal AF private data length.<br><br>In case of error, current transport packet is dropped. |
| PES_HDR_STATUS | 8:6 | '000' | Current status of the PES packet parser:<br><br>'000' – No error.<br>'001' – Video / audio stream_id mismatch.<br>'010' – Non-video / audio stream_id.<br>'011' – Syntax error on 2 MS bits of PES byte 6<br>'100' – Scrambled PES packet |
| DROP_TP_IF_SCRAMBLED (R) | 9 | '0' | Status bit: set to '1' if parser is configured to drop scrambled transport packet AND current packet is scrambled, otherwise status is set to zero. |
| DROP_PES_IF_SCRAMBLED (R) | 10 | '1' | Status bit: set to '1' if parser is configured to drop scrambled PES packet AND current PES packet is scrambled, otherwise status is set to zero. |
| IGNORE_PES_HDR_ERROR (R) | 11 | '0' | Status bit: set to '1' if parser is configured to ignore errors on the PES header AND current PES header has errors, otherwise status is '0'. |
| (reserved) | 31:12 | 0x00000 | Unused bit-field, always set to zero. |

FIG. 8

| TD_PCR_PID_CNTL [RW] 32 bits (access: 32) | | | |
|---|---|---|---|
| **Field Name** | **Bits** | **Default** | **Description** |
| PCR_PID | 12:0 | 0x1FFF | PID value of the transport packet used to extract stream time (samples of the reference program clock). |
| FORCE_PCR_LOAD | 13 | '0' | Control of the PCR loading process: 0=Do not load next PCR sample to the STC cnt.; 1=Load next PCR sample to the STC counter |
| ROUTE_PCR_PACKET | 14 | 0x0 | PCR packet routing control: 0=Execute a PCR process instead; 1=Route packet with PCR PID different than a video or audio PID to the memory queue. |
| (reserved) | 31:15 | 0 | Reserved bit-field, always set to 0. |

FIG. 9

| TD_SM_CNTL [RW] 32 bits (access: 32) | | | |
|---|---|---|---|
| **Field Name** | **Bits** | **Default** | **Description** |
| RST_AT_EVERY_PES_SCP | 0 | 0x0 | <No Description> |
| AF_PRVT_ZERO_CMP | 5:1 | 0x4 | <No Description> |
| VIDEO_AUDIO_SWITCH | 6 | '0' | If set to '0' allows monitoring of video parser.<br>If set to '1' allows monitoring of audio parser. |
| (reserved) | 31:6 | 0x000 | Unused bit-field, always set to zero. |

| TD_SM_[R] 32 bits (access: 32) | | | |
|---|---|---|---|
| **Field Name** | **Bits** | **Default** | **Description** |
| FRAMER_STATE | 2:0 | '000' | States of the transport packet framer:<br>0=FRAME_BYTE; 1=SYNC_SEARCH; 2=SYNC_LOST;<br>3=SYNC_VERIFY; 4=SYNC_LOCK |
| TPHP_STATE | 6:3 | '0000' | States of the transport packet header parser:<br>0=IDLE; 1=TPHDR0; 2=TPHDR1; 3=TPHDR2; 4=TPHDR3; 5=VIDEO_AF<br>6=VIDEO_PES; 7=AF_PCR_ONLY;<br>8=AF_PCR_ROUTE; 9=FULL_PACKET_ROUTE |
| AFP_STATE | 10:7 | '0000' | States of the adaptation field parser:<br>0=IDLE; 1=AF_LEN_EXTRACT ; 2=AF_FLAGS_EXTRACT ;<br>3=PCR_EXTRACT; 4=OPCR_SKIP; 5=SPLICE_CNTDWN_EXTRACT;<br>6=PRIVATE_DATA_LEN_EXTRACT; 7=PRIVATE_DATA_EXTRACT ;<br>8=AF_EXT_LEN_EXTRACT; 9=AF_EXT_SKIP; 10=STUFFING_SKIP |
| PESP_STATE | 15:11 | '00000' | States of the PES parser:<br>0=IDLE; 1=PESHDR0; 2=PESHDR1; 3=PESHDR2; 4=PESHDR3;<br>5=PESHDR4; 6=PESHDR5; 7=PESHDR6; 8=PESHDR7; 9=PESHDR8;<br>10=PTSDTS_EXTRACT; 11=ESCR_EXTRACT; 12=ESRATE_EXTRACT;<br>13=DSM_EXTRACT; 14=ADDCOPY_EXTRACT; 15=PES_CRC_EXTRACT;<br>16=PES_EXT_EXTRACT; 17=PES_PRIVATE_DATA_EXTRACT;<br>18=PACK_HEADER_FIELD_EXTRACT; 19=PACK_HEADER_SKIP;<br>20=PPSC_EXTRACT; 21=PSTD_BUFFER_EXTRACT;<br>22=PES_EXT2_EXTRACT; 23=PES_EXT2_SKIP;<br>24=STUFFING_EXTRACT; 25=PAYLOAD_EXTRACT |
| CC_STATE | 18:16 | '000' | States of continuity counter verifier on non-PCR PID:<br>0=CC_IDLE ; 1=CC_COMP; 2=CC_LOAD; 3=CC_INC<br>4=CC_AF_LEN; 5=CC_DSCNT_IND |
| PCRCC_STATE | 21:19 | '000' | States of continuity counter verifier on PCR PID.<br>0=PCRCC_IDLE; 1=PCRCC_COMP; 2=PCRCC_LOAD; 3=PCRCC_INC;<br>4=PCRCC_AF_LEN; 5=PCRCC_DSCNT_IND |
| (reserved) | 31:22 | | Unused bit-field, always set to zero. |

FIG. 10

| TD_AUDIO_PID_CNTL [RW] 32 bits (access: 32) | | | |
|---|---|---|---|
| **Field Name** | **Bits** | **Default** | **Description** |
| AUDIO_PID | 12:0 | 0x1FFF | Packet_id (PID) value of the transport packet containing audio stream. |
| AUDIO_ENABLE_PARSING | 13 | '0' | Set to '1' to enable audio parsing system. Set to '0' to disable audio parsing from the next transport packet. |
| AUDIO_BUFFER_INDEX | 20:14 | '000000' | One out of sixty four buffers in the system memory where audio data can be routed while it is simultaneously routed to external hardware audio decoder. |
| AUDIO_START_FROM_PUSI | 21 | '0' | If set to 0, audio parsing starts from the current transport packet. If set to '1' audio parsing starts from the transport packet where payload_unit_start_indicator is set to '1'; |
| AUDIO_PROCESS_STREAM_ID | 22 | '0' | If set to 0, filter on stream_id is switched off.<br>If set to 1, filter on stream_id is enabled. Audio PES packet is dropped if its stream_id is outside of 0xC0 – 0xDF range or if it is not set to private_stream_2 value. |
| AUDIO_STREAM_ID | 30:23 | 0xc00 | Audio stream_id value to filter upon. |
| IGNORE_AUDIO_TEI | 31 | 0x0 | If set to '1' audio transport packet parser will ignore all error flagged transport packets, i.e. audio packets with TEI bit set to '1'. |

| TD_AUDIO_PID_CNTL2 [RW] 32 bits (access: 32) | | | |
|---|---|---|---|
| **Field Name** | **Bits** | **Default** | **Description** |
| AUDIO_ENABLE_PES_OUT | 0 | 0x0 | Control of the bus-mastered audio output to the AUDIO_BUFFER_INDEX queue in the system memory.<br>Set to '1' to enable bus mastering of audio PES packets to circular buffer in the host memory. Set to '0' to disable bus mastering of audio PES packets. |
| AUDIO_ENABLE_ES_OUT | 1 | '0' | Control of the bus-mastered audio output to the AUDIO_BUFFER_INDEX queue in the system memory.<br>Set to '1' to enable bus mastering of audio ES packets to circular buffer in the host memory.<br>Set to '0' to disable bus mastering of audio ES packets. |
| MASK_I2S_REQ | 2 | '0' | Control of the audio PES packet output towards external hardware audio decoder:<br>Set to '0' to enable PES audio output to external audio decoder.<br>Set to '0' to disable PES audio output to external audio decoder. |
| (reserved) | 31:3 | | Reserved bit-field, always set to 0. |

FIG. 11

| GEN_INT_CNTL [RW] 32 bits (access: 8/16/32) | | | |
|---|---|---|---|
| **Field Name** | **Bits** | **Default** | **Description** |
| (other interrupt sources) | 3:0 | 0x0 | Other sources of interrupt |
| (reserved) | . 12:4 | 0 | Unused bit-field, always set to zero. |
| I2S_FIFO_DATA_REQ_ INT_EN | 13 | '0' | Enables / disables interrupt when request for more bit-stream data occurs from external hardware audio decoder.<br>0=Disable<br>1=Enable |
| (reserved) | 15:14 | '00' | Unused bit-field, always set to zero. |
| (other interrupt source) | 19:16 | 0x0 | Other source of interrupt. |
| (reserved) | 23:20 | 0x0 | Unused bit-field, always set to zero. |
| CHIP_INT_EN | 25 | '0' | Global interrupt enable / disable at the chip level<br>0=Disable ; 1=Enable |
| (reserved) | 31:26 | '000000' | Unused bit-field, always set to zero. |

| GEN_INT_STATUS [RW] 32 bits (access: 8/16/32) | | | |
|---|---|---|---|
| **Field Name** | **Bits** | **Default** | **Description** |
| (other interrupt sources) | 3:0 | 0x0 | Status of other source of interrupt. |
| (reserved) | 7:4 | 0x0 | Unused bit-field, always reads as zero. |
| (other interrupt source) | 8 | '0' | Status of other source of interrupt. |
| (reserved) | 9 | '0' | Unused bit-field, always reads as zero. |
| (other interrupt source) | 10 | '0' | Status of other source of interrupt. |
| (reserved) | 12:11 | '00' | Unused bit-field, always reads as zero. |
| I2S_FIFO_DATA_REQ_INT_AK (W) | 13 | '0' | Clear I2S interrupt request by setting this bit to 1.<br>0=No effect<br>1=Clear status |
| I2S_FIFO_DATA_REQ_INT (R) | 13 | '0' | I2S interrupt request status indicator.<br>0=No event<br>1=Event has occurred, interrupting if enabled. |
| (other interrupt source) | 14 | '0' | Status of other source of interrupt. |
| (reserved) | 15 | '0' | Unused bit-field, always reads as zero. |
| (other interrupt source) | 16 | '0' | Status of other source of interrupt. |
| (reserved) | 23:20 | 0x0 | Unused bit-field, always reads as zero. |
| (other interrupt sources) | 25:21 | '00000' | Status of other source of interrupt. |
| (reserved) | 31:26 | '000000' | Unused bit-field, always reads as zero. |

FIG. 12

SYSTEM AND METHOD FOR RECEPTION, PROCESSING AND TRANSMISSION OF DIGITAL AUDIO STREAM

FIELD OF THE DISCLOSURE

The present invention relates generally to the parsing of transport stream data, and specifically to the parsing of audio stream data a multiplexed data stream

BACKGROUND

The international organization for standards (ISO) moving pictures experts group (MPEG group) approved an audio video digital compression standard known as MPEG-2 in an effort to provide a versatile compression standard capable of being utilized for a wide variety of data. The MPEG-2 standard provides explanations needed to implement an MPEG-2 decoder through the use of syntax and semantics of a coded bit stream. MPEG-2 is an open standard which continues to evolve and be applied to a variety of applications ranging from video conferencing to high definition television. As a generic standard, MPEG-2 is to be used for variety of audio and video coding applications Part one of the MPEG-2 standard (ISO 13818-1), was designated to improve error resilience and carry multiple programs simultaneously without a common time base between programs.

The transport stream (TS) specified by the MPEG-2 standard offers a high degree of robustness for noisy channels and can be used to carry multiple programs, such as multiple television (TV) services. The transport stream is based on a 188 byte long packet suited for hardware error correction and processing schemes. The use of a robust protocol, such as the transport stream, allows for reception over noisy environments such as terrestrial and satellite transmissions. Even in these environments it is possible to obtain fast program access, channel hopping, and synchronization between multiple elementary streams carried within the packetized elementary streams, which are subdivided into transport packets.

Prior art FIG. 1 illustrates a Transport Packet Stream defined by the MPEG-2 standard. The transport stream, based on a 188 byte long packet, is well suited for hardware error correction and processing schemes. Such a configuration can carry multiple programs within the same multiplex, even when the transmission environment is noisy. For example, MPEG-2 data can be transferred successfully over coaxial cable networks and satellite transponders with asynchronous multiplexing of constant or variable bit-rate programs to allow fast program access, channel hopping and synchronization between services.

As illustrated further in FIG. 1, an MPEG-2 transport stream consists of fixed length Transport Stream Packets (TSP or packets) based on 4 bytes of header followed by 184 bytes of TSP payload. TSP payload carries Packetized Elementary Stream (PES) data obtained by chopping up an Elementary Stream (ES), which consists of data of a common type and program. For example, audio for a specific program would form one elementary stream, while video for the same program would form a second elementary stream.

The TS header consists of a synchronization byte (SyncByte), flags, information indicators for error detection and timing, an adaptation field indicator, and a Packet_ID (PID) field used to identify Elementary Streams carried in the payload. The adaptation field, when present, contains flags, and timing information.

The PID Field is used not only to distinguish separate Elementary Streams, but also separate Program Specific Information (PSI) tables. Prior art FIG. 2 illustrates two types of PSI tables: a Program Association Table 210 (PAT); and a Program Map Table 220 (PMT). The PAT table lists unique program numbers as identifiers for each program, or elementary stream, in a multiplex, and the PID number associated with each program number. A fixed PID number of 0x0000 is assigned to the PAT table, making it possible for the system to download the PAT table on startup by retrieving PID 0x0000 packets.

Each program identified in the PAT table has a related Program Map Table (PMT) having its own PID identifier. Each PMT table lists the PIDs for all Elementary Streams (components) making a given program associated with the PMT. A specific PMT table may be constructed for each program separately, or may be common for a group of programs. In the first case, there are many PMT tables with just one section, and each PMT table has a different PID value. In the second case one PMT table may have many sections, each relevant to one program.

In order to provide multiple services over the same multiplex, data associated with different multimedia services are transmitted, with packet multiplexing, such that data packets from several Elementary Streams of audio, video, data, and others are interleaved on a packet by packet basis into a single MPEG-2 transport stream. Synchronization between Elementary Streams forming a common program is achieved using presentation time stamps and program clock references which can be transmitted as part of the adaptation field specified in the header.

Prior art FIG. 3 illustrates the fields associated with a PES stream. Each PES stream contains a header portion and a data portion. In addition, an optional header portion may exist. The header portion includes a Packet Start Prefix, a stream ID, and a packet length indicator.

Transport stream information can be provided either through a direct broadcast, or through a service provider broadcast. Direct broadcast generally refers to signals which are received directly by an end user. Examples of direct broadcasts include satellite broadcasts received by satellite dishes and provided to a decoder at the end user's location, which receives and decodes the transport stream data. Another type of direct broadcast is the traditional composite television/radio broadcast. In their most elementary forms, these broadcasts are not digital broadcasts. However, the transmission of digital broadcast in MPEG-2 format is being explored and occurring as an alternative. In this manner, the user would have a tuner capable of receiving the direct terrestrial link information containing the television or radio signals. Once demodulated, the transport stream information could be provided to a desktop unit, or decoder, owned by the end user.

Service provider broadcast would include broadcast to the home provided by cable television providers, telephone company providers, or other independent providers. In this configuration, the service provider first receives the number of signals which can be ultimately provided to the end user. Examples of such received signals include satellite feeds, terrestrial feeds, switched video sources, local video sources such as tapes, or laser disk DVD's, as well as traditional table feeds. Based upon the end users demands, the received information can be selectively provided to the end user.

In one manner, the selected feed by the service provider can be provided directly to an end user through a twisted pair connection, which may include a high speed digital subscriber link (DSL) capable of providing data at higher rates than traditionally associated with plain old telephone system (POTS) connections.

In another implementation, the service provider would provide information from a central office or a head-end to a fiber node. A specific fiber node is generally used to support more than one end user. Examples of the use of such fiber nodes includes a fiber coaxial bus (FCB) whereby a fiber link provides the signal containing a large amount of data to a fiber node which in turn drives coaxial cable having a taps. A decoding device attached to taps at user side can receive the appropriate broadcasting signal.

Another example of a fiber node is bi-directional fiber coaxial bus. While similar to the FCB bus, the bi-directional FCB bus is also capable of transmitting data back to the central office or the head-end as well as receiving it. Yet another fiber node example is a hybrid fiber coax, which uses coaxial cable and branch topology toward network interface units. Yet another example associated with service providers is known as fiber to the curb, whereby digital signaling is carried from the central office to the optical network unit which serves only a few dozen homes. Locally, a hybrid twisted pair coaxial pairs will connect to the optical network unit with the consumer's decoder. Twisted pair cable carries digital video in the 5 to 40 megahertz range to no more than 500 feet from the fiber connection. Therefore, the number of homes capable of being served by a single optical network unit is limited. Analog television signals are carried in a coaxial cable from the fiber node.

One problem associated with the flexibility of the MPEG-2 standard is that once the transport stream is received, demodulated, and decrypted, the resulting data stream can still have variations that need be known before the data stream can be properly utilized. For example, the MPEG-2 specification does not indicate a specific set of control signals to be provided with the transport stream, how received data and control signals are qualified, nor the precise format of the actual data transmitted. As a result, implementations of set top boxes require specific service provider information. Specific service provider information results in an incompatibility among transport streams schemes provided by different service providers or cable operators. As a result, chip sets are designed and dedicated to support specific service provider's set top boxes.

Prior art FIG. 4 illustrates a prior art system for parsing a transport stream. The transport parser of the prior art would receive individual packets from the framer. Based upon the PID value, the transport parser would store the TSP data to be used by the system or the graphics engine in a local buffer.

When the transport parser's local buffer was filled, the transport parser would cause a bus request to the appropriate controller (system or video) to initialize a transfer of at least some of the buffered data.

However, when the prior art host video or graphics system needed more data from the transport parser prior to the transport parser initializing the transfer, the system would initialize the transfer by generating a request to access data in the transport parser buffer. Since the bus used internally by the transport parser buffer may have other clients, the host system may have to wait to access the bus. The overall performance of the host system is reduced as a result of the system waiting on data. Therefore, a system and method of receiving transport stream information that allows for more flexibility and improved performance in terms of data handling, data parsing, design implementation, data stream acquisition would be advantageous.

BRIEF DESCRIPTION OF THE DRAWINGS

FIG. 7 are tables illustrating registers for monitoring data related to processed transport packet fields, according to one embodiment of the present invention;

FIG. 8 is a table illustrating fields of a register for providing the status of various data stream parsers, according to one embodiment of the present invention;

FIG. 9 is a table illustrating fields of a register for configuring options related to the processing of program clock reference values, according to one embodiment of the present invention;

FIG. 10 is a table illustrating registers associated to the operation of parser state machines, according to one embodiment of the present invention;

FIG. 11 is a table illustrating registers for configuring options related to an audio parser, according to one embodiment of the present invention; and FIG. 12 is a tables illustrating various control and status registers associated with the operations of system interrupts, according to one embodiment of the present invention.

DETAILED DESCRIPTION OF THE FIGURES

One embodiment of the present invention provides for a method of parsing audio data packets from a transport stream. The method includes receiving transport packets. In one embodiment, independent packets of a transport stream are identified through a transport packet framer. The method includes identifying a transport packet as containing audio stream data. In one embodiment, a transport packet parser identifies transport packets related to audio data through packet identifier values associated with audio programs. The method also includes comparing the value of a first field in the transport packet to a value of a first field register to determine a first outcome. In one embodiment, an audio parser compares a stream identifier related to the first field register to stream identifiers of supported audio streams. The method further includes determining whether to enable audio stream data related to the transport packet to be received by a host system or to discard the transport packet, based upon the first outcome. An advantage of at least one embodiment of the present invention is that transport packets associated with supported audio data may be efficiently identified and processed by dedicated system components.

Figure 5:
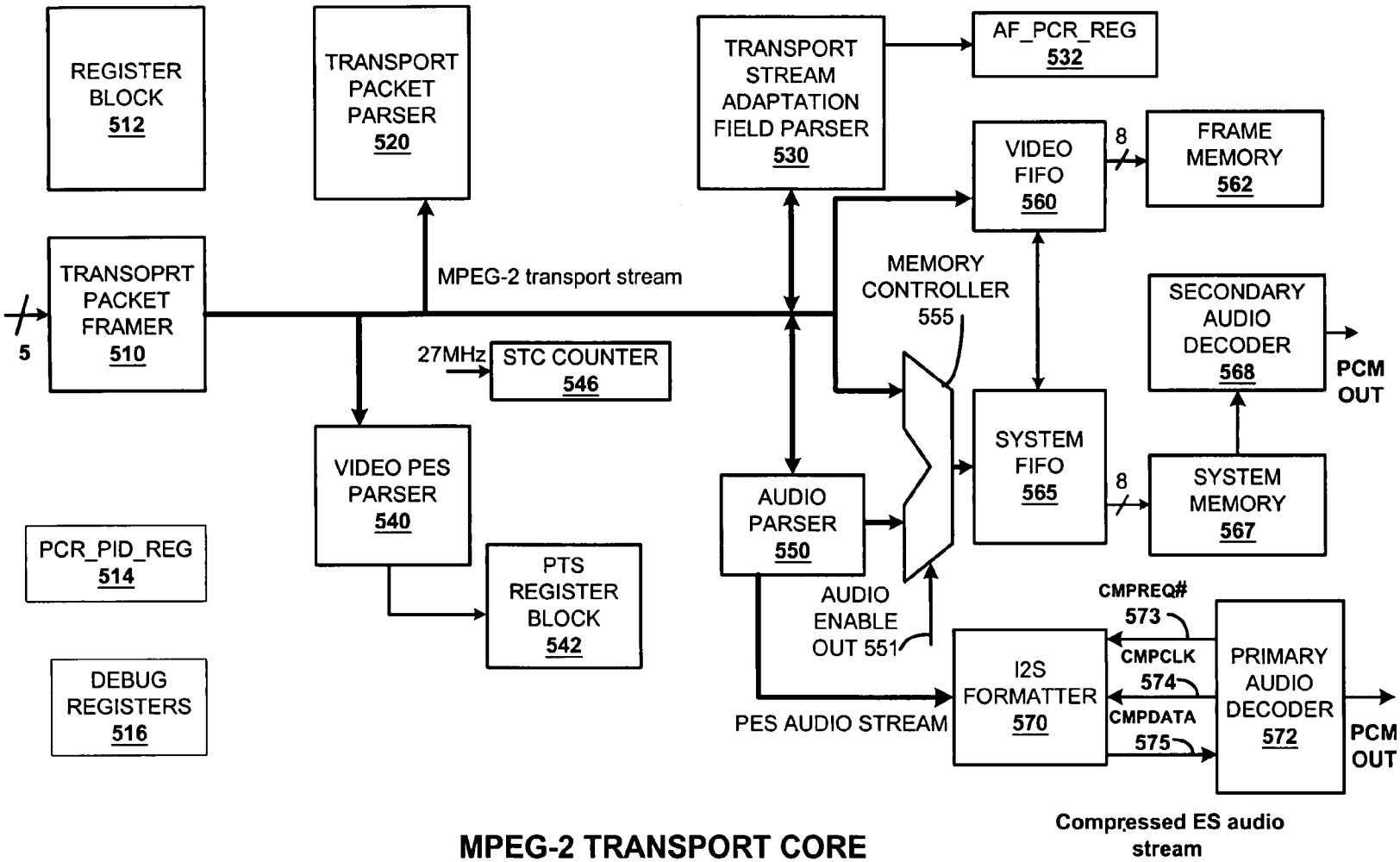
FIG. 5 is a block diagram illustrating a system for parsing multimedia data streams, according to one embodiment of the present invention.

Referring now to FIG. 5, a system for parsing multimedia data streams is shown, according to one embodiment of the present invention. A framer 510 receives a data stream. In one embodiment, the data stream is an MPEG transport stream. The framer 510 provides signals indicating the start of packets within the transport stream. Various parsers 520, 530, 540 and 550 are used to identify specific transport packets within the transport stream and provide packetized elementary stream (PES) packets or elementary streams (ES) data associated with the transport stream. Specific embodiments of the framer 510, the transport packet parser 520, transport stream adaptation field parser 530 and video PES parser 540, as described herein, are disclosed in pending patent application Ser. No. 09/490,350, which is hereby incorporated herein by reference. Specific states of operation of framer 510 are provided in more detail in reference to FIG. 10.

A transport packets parser (TPP) 520 may be used to select transport packets with specific packet identifier (PID) values. In one embodiment, the TPP 520 compares PID values within transport packets of the transport stream to decide whether or not to pass the transport packet. The PID value used for comparison may be selected through a software application designed to run on top of the system. Specific states of operation of TPP 520 are provided in more detail in reference to FIG. 10.

Figure 6:
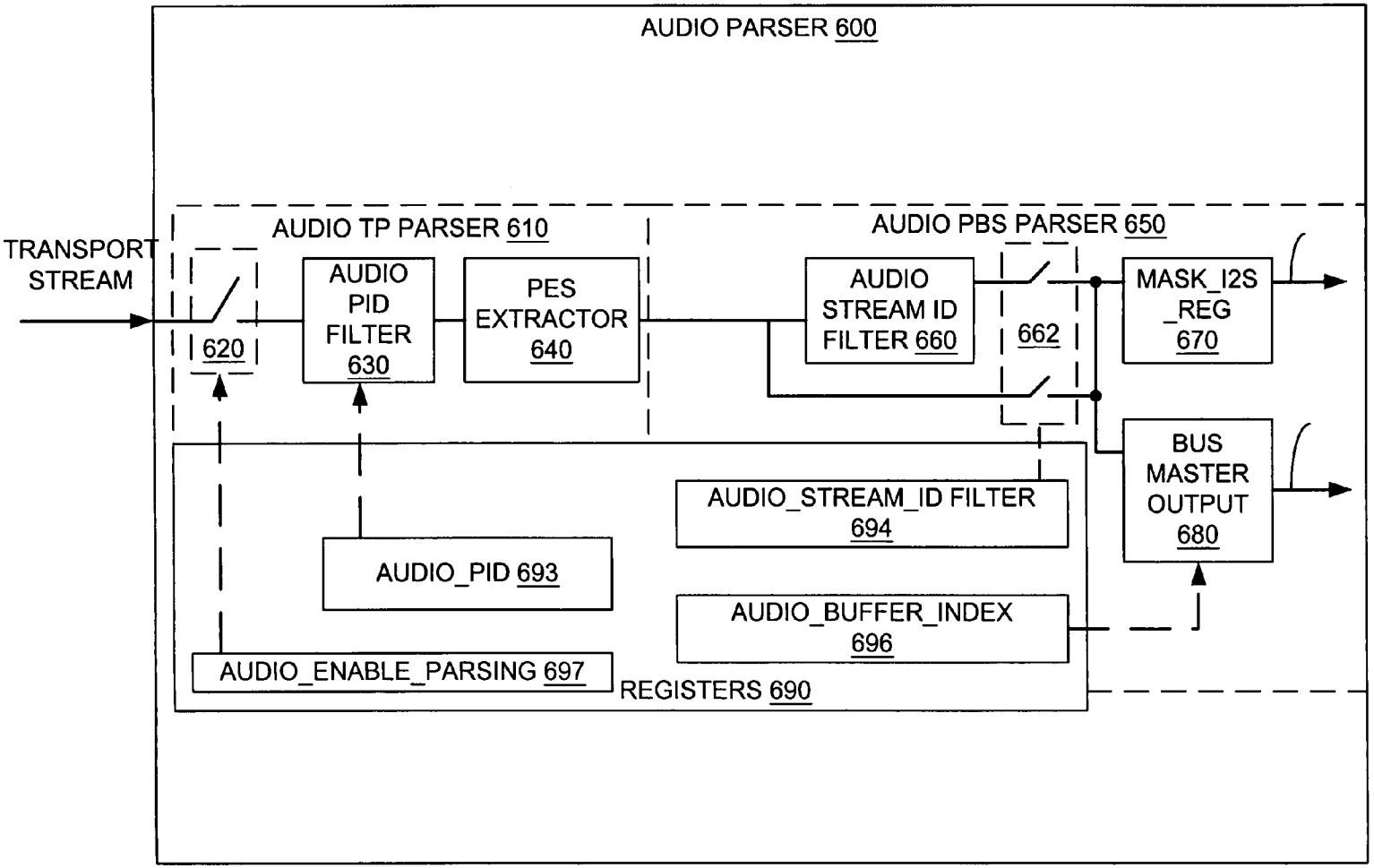
FIG. 6 is a block diagram illustrating a system for parsing audio stream data, according to one embodiment of the present invention.

In one embodiment, TPP 520 analyses transport packets to determine which of the other parsers, such as transport stream adaptation field parser 530, video PES parser 540 or audio parser 550, the transport packet should be processed through. For example, if TPP 520 identifies a transport packet with a PID associated with video data, TPP 520 may enable video PES parser 540 to process the packet. TPP 520 may provide the PID of the particular packet to video PES parser 540, allowing video PES parser 540 to identify the appropriate transport packet. If TPP 520 identifies a transport packet with a PID value associated with audio programs, TPP 520 may enable audio parser 550. In one embodiment, audio parser 550 is enabled through an AUDIO_ENABLE_PARSING register 692 (FIG. 6). TPP 520 may also store the PID value of the identified transport packet in a register, such as AUDIO_PID register 693 (FIG. 6), allowing audio parser 550 to identify the particular transport packet.

Figure 1:
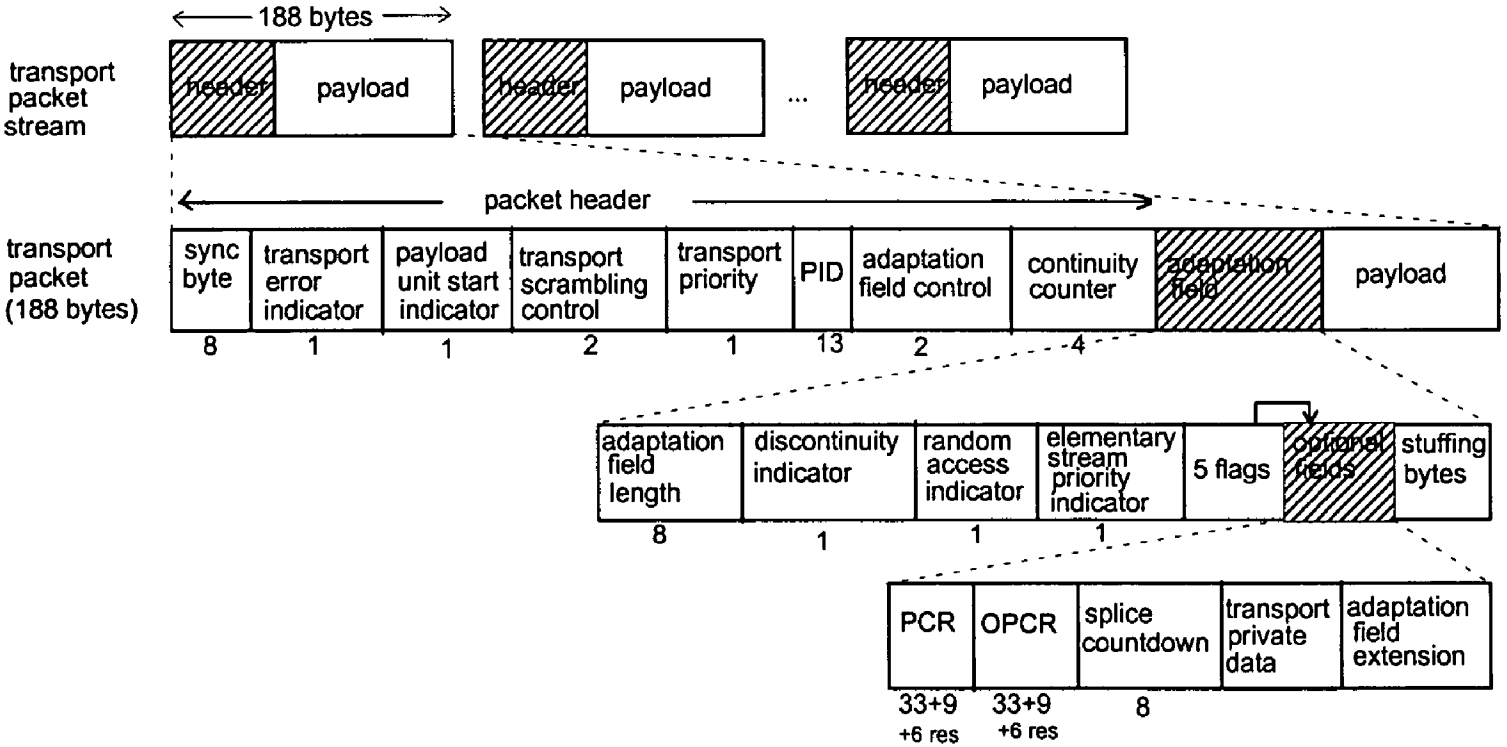
FIG. 1 is a block form illustrating prior art fields associated with a packetized stream packet.

A transport stream adaptation field parser (TSAFP) 530 may be used to select data from transport packets identified as having specific adaptation field data as shown in Prior-art FIG. 1. In one embodiment, TSAFP 530 is used to extract program clock reference (PCR) values, found within the adaptation field. The PCR values may be used to synchronize a local system clock, such as system time clock (STC) counter 546. In one embodiment, the extracted PCR values are stored in a PCR register, such as AF_PCR_REG register 532. The PID values related to transport packets used to extract PCR values from may be stored in a separate register, such as PCR_PID_REG register 514. In one embodiment, TSAFP 520 is enabled through TPP 520. In other embodiments, TSAFP compare the transport packet PIDS to a predefined PID to determine which packets to parse. Specific states of operation of TSAFP 520 are provided in more detail in reference to FIG. 10.

Figure 3:
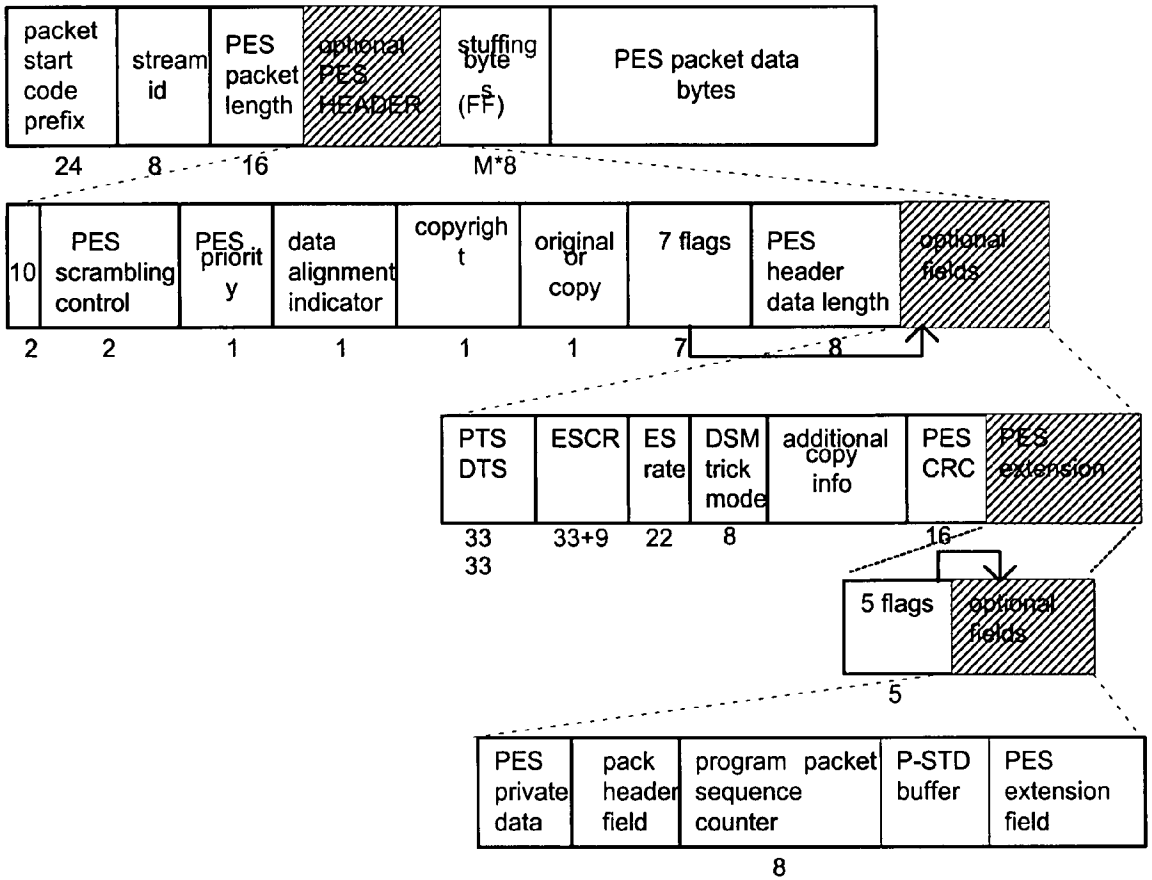
FIG. 3 is a block form illustrating prior art fields associated with Packetized Elementary Stream.
Figure 4:
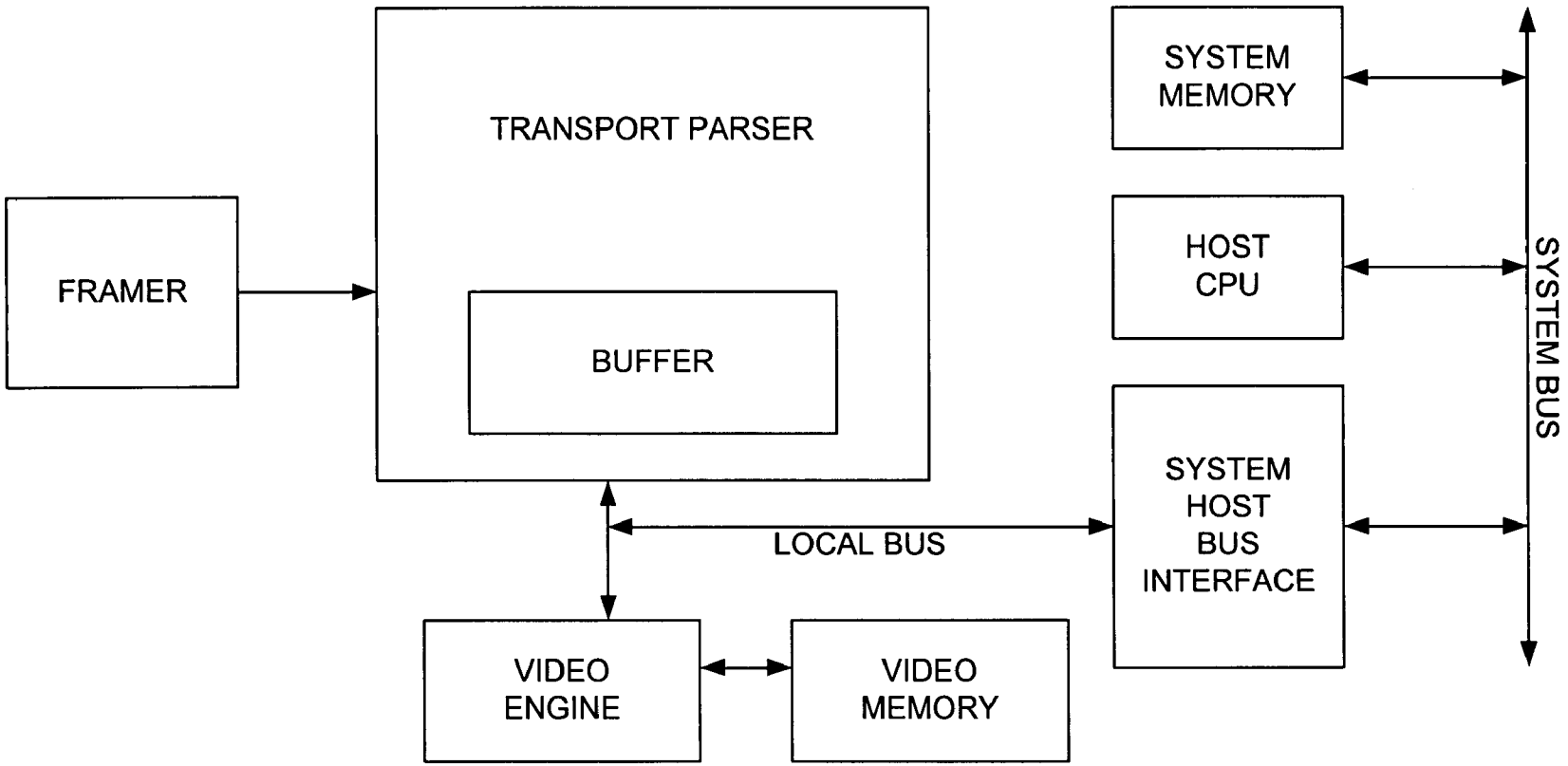
FIG. 4 is a block form illustrating prior art fields associated with Section Packets.

A video PES Parser (PESP) 540 is used to and/or parse specific transport packets related to a video PES. In one embodiment, fields (as shown in Prior-art FIG. 3) within PES packets are parsed and passed to a PES register block 542. The PES packets may also be stored in memory, such as video FIFO 560, or system FIFO 565. The PES packets related to video may also be processed into video frames through a video decoder (not shown) and stored in frame memory 562. In one embodiment, PESP 540 is enabled through TPP 520, in other embodiments, the video PESP determines which transport stream packets contain video data by comparing PID values to a stored Video PID value. Specific states of operation of PESP 540 are provided in more detail in reference to FIG. 11.

Control settings for configuring framer 510, TPP 520, TSAF 530 and PESP 540 are provided through sets of registers, such as register block 512. Status information may also be included in registers of register block 512. Further detail regarding the types of controls or information available through register block 512 is provided in reference to FIG. 8. Information regarding the status of the state machines in regards to operations in framer 510, TPP 520, TSAF 530 and PESP 540 is provided through state machine debug registers 516. In one embodiment, the status of framer 510 and parsers 520, 530, and 540 is monitored through an application through field values within register block 512 and/or state machine debug registers 516. Configuration settings to various operating parameters are made through an application by asserting values to corresponding fields within register block 512 and/or state machine debug registers 516. Note that various registers illustrated in FIG. 5 may be part of a common register/storage location.

An audio parser 550 is provided to select transport packets that contain audio stream data. In one embodiment, audio parser 550 identifies transport packets related to audio stream by comparing transport stream packet PID values to data through PID values known to be associated with audio streams. In one embodiment, audio parser 550 extracts audio PES and audio ES data from selected transport packets. The audio data related to the selected transport packets is passed for processing by an external decoder, such as primary audio decoder 572. In one embodiment, TPP 520 provides the PID values of the transport packets related to audio stream data and enabled audio parser 550 to parse the transport packet.

In one embodiment, PES audio data output through audio parser 550 is processed into I2S audio data formatted by an I2S formatter 570. In one embodiment, the audio stream data generated through audio parser 550 includes PES audio stream data. The PES audio stream data is organized into sets of audio packets to be decoded by primary audio decoder 572, the PES audio stream data is converted into ES data and output to the audio decoder 572, using I2S formatter 570. In one embodiment, I2S formatter 570 utilizes an internal FIFO to perform parallel to I2S conversion on the data from the PES audio stream. In one embodiment, ES data associated with the PES audio stream data is compressed and provided to the decoder 572 according to I2S standards, allowing it to be processed into digital audio data, such as a pulse-coded modulation (PCM) audio data, by an audio decoder, such as primary audio decoder 572. An external digital audio receiver (not shown) may then process the PCM audio data for presentation, such as through audio speakers (not shown).

In one embodiment, the transfer of processed audio data between I2S formatter 570 and primary audio decoder 572 is performed through a set of data lines 573-575. CMPREQ# line 573 uses an active low request signal. The request signal is generated by primary audio decoder 572 to request more data from I2S formatter 570. The signal on CMPREQ# line 573 stays at a low active low level as long as there is more room for new data in a compressed bit-stream buffer internal to primary audio decoder 572. An active low edge signal may also be used to cause an interrupt that a host processor can use when bus mastering PES or ES data from system memory 567 to a separate external decoder, such as secondary audio decoder 567 (useful when data is retrieved from digital storage media, like DVD).

CMPCLK line 574 uses a rising edge active signal for clocking serial audio bit-stream data out of I2S formatter 570. In one embodiment, primary audio decoder 572 generates the signal. In one embodiment, the FIFO internal to I2S formatter 570 is 64DWORD long and used to compensate bursty audio data in the transport stream received through audio parser 550. CMPDATA line 575 is used to transfer the actual compressed audio bit-stream from I2S formatter 570 to primary audio decoder 572. It should be noted that sending data at the PES level allows delivery of audio presentation time stamp (PTS) information contained in audio PES packet headers in a timely manner.

In an alternate embodiment, PES, or ES, audio data processed through audio parser 550 is transferred to system memory 567, through system FIFO 565 and memory controller 555. In one embodiment, memory controller 555 uses a data enable signal, such as AUDIO_ENABLE_OUT signal 551. If asserted, AUDIO_ENABLE_OUT signal 551 instructs memory controller 555 to pass audio stream data generated through audio parser 550 to system FIFO 565. Alternatively, data from TPP 520, TSAFP 530 and PESP 540 is given access to system FIFO 565. In one embodiment, audio stream data generated through audio parser 550 is provided a buffer index, indicating a specific FIFO of system FIFO 565 or system memory 567 to be stored in. Accordingly, by providing the location to store data from audio parser 550, the data may be bus-mastered into memory. ES data processed through I2S formatter may also be bus-mastered into memory, such as system memory 567. In one embodiment, AUDIO_ENABLE_OUT signal 551 is directly related to the status of AUDIO_ENABLE_PES_OUT and AUDIO_ENABLE_ES_OUT fields, which are described further in reference to FIG. 11. In one embodiment audio data is received from the live feed and parsed by internal TSP parser to be sent to external decoder as PES data and a memory buffer as transport stream data. In another embodiment, data is sent as PES data to external decoder and PES or ES data to the memory buffer.

Once stored in memory, an external audio decoder, such as secondary audio decoder 568 may access the stored audio streams from system memory 567. In one embodiment, primary and secondary audio decoders 572 and 568 include MPEG, AC-3, AAC, or DTS audio decoders. It should be noted that by storing audio data using a PES format, timing information, such as through PTS values and start codes, may be provided to a processing decoder system, such as secondary audio decoder 568. The processing decoder system may determine the type of audio data and/or the sampling rate of the data through analysis of the start codes found in the PES audio data. Furthermore, the PTS values may be used to determine the proper time to play decoded audio data. An application may be used to apply requests in audio decoders 568 and 572. For example, a user may select an option to play a particular audio track associated with a DVD. The user may select the option on an application, through the use of a mouse or keyboard (not shown). The selection to play a particular stored audio program may also be triggered through a system clock or alarm, such as to provide indication of received e-mail. The application may then generate an interrupt to request the audio data from decoders 568 and 572. In one embodiment, audio decoders 568 and 572 are hardware components. Alternatively, the audio decoders 568 and 572 may be represented through software. In one embodiment, register values are polled to acknowledge the interrupted requests, as described further in reference to FIG. 12.

Referring now to FIG. 6, a block diagram of an audio parser 600 is illustrated, according to one embodiment of the present invention. Audio parser 600 receives transport stream provided through a transport stream framer, such as framer 510 (FIG. 5) and provides PES audio stream data related to selected transport packets. An audio TP parser 610 is used to select specific transport packets containing audio stream data. An audio PES parser 650 is used to select PES stream data related to specific audio types.

Figure 2:
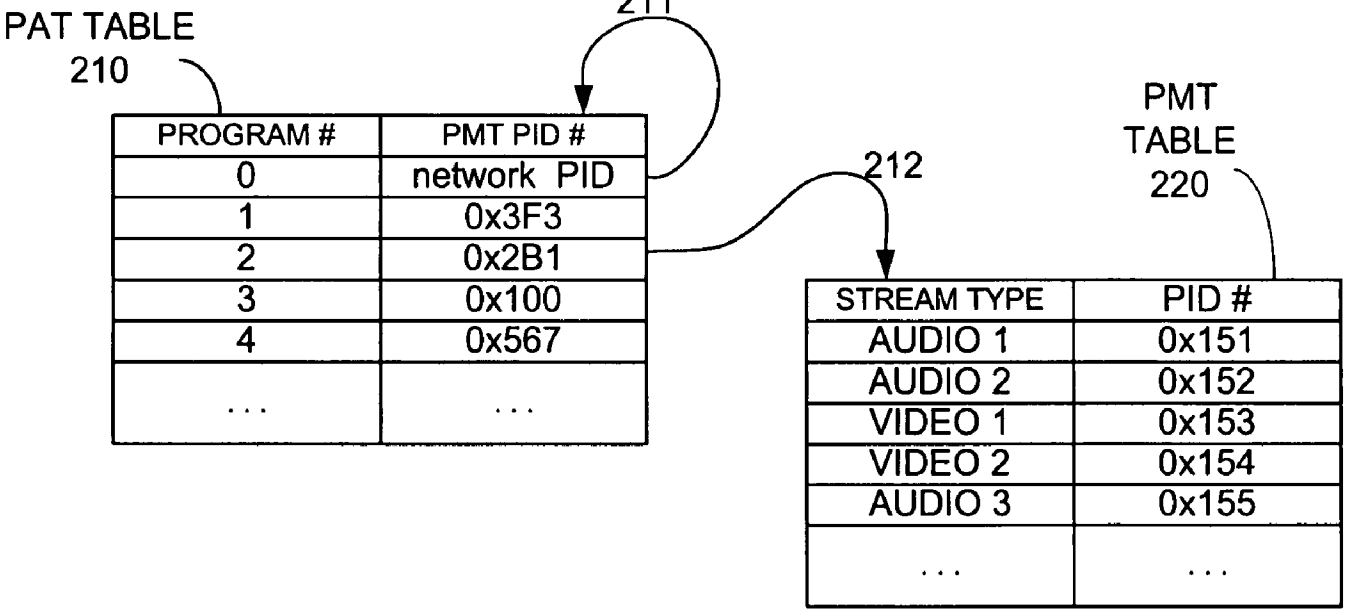
FIG. 2 is a table illustrating a prior art Program Specific Information tables.

A register, AUDIO_ENABLE_PARSING register 692 may be used to enable processing performed through audio parser 600. In one embodiment, AUDIO_ENABLE_PARSING register 692 is used by parsing selector 620, which determines whether or not to allow audio TP parser 610 to receive transport packets from a transport stream. An audio PID filter 630 may be used to compare the PID of the transport packet, being received through the transport stream, to a PID value stored in a register, such as AUDIO_PID register 693. In one embodiment, the PID of a transport packet associated with an audio stream is stored in AUDIO_PID register 693 through an application program, or hardware. AUDIO_ENABLE_PARSING register 692 may be set by an external parser, such as a transport packet parser, once the external parser has detected a transport packet which is related to an audio program or may be a register that is set by an application. As shown in Prior-art FIG. 2, analysis of processed program map tables (PMT) may be used to identify PID values associated with audio streams. Transport packets that do not have matching PID values are disregarded. In one embodiment, a disregarded transport packet is simply not passed to any further processing components of audio parser 600.

In one embodiment, transport packets with PID values matching AUDIO_PID 693 are passed to PES extractor 640. In one embodiment, audio data is found within a payload section of the transport packet passed by audio PID filter 630. PES extractor 640 passes the audio data to audio PES parser 650. Audio PES parser 650 performs analysis on the data related to the received transport packet to determine whether or not to pass the data. In one embodiment, audio PES parser 650 includes an audio stream ID filter 660. Audio stream ID filter 660 compares a stream_ID field within the PES audio data (as shown in Prior-art FIG. 3) to a list of known stream ID values. In one embodiment, the known stream ID values indicate particular audio stream types that are supported by the processing system, or an external audio decoder. For example, in one embodiment, only PES packets with stream ID values within the range of 0xC0-0xDF, or indicating a specific private stream ID, may be processed and packets with stream ID values outside of those ranges are discarded by audio stream ID filter 630.

An audio stream filter selector 662 may be used to enable or disable audio stream ID filter 660. An AUDIO_STREAM_PROCESS_ID register 694 may be monitored to provide an indication to audio stream filter selector 662, whether or not to allow the PES data to be processed through audio stream ID filter 660. In one embodiment, data that has been passed may be sent to an external I2S audio decoder. A MASK_I2S_REQ component 670 may be used to enable or disable the output of the PES data to the external I2S decoder. In one embodiment, a MASK I2S_REQ register value is set to enable or disable the output.

In one embodiment, the passed data is bus-mastered to memory through a bus master output component 680. An AUDIO_BUFFER_INDEX register 696 is used to provide an index to identify a FIFO or location of memory to store a particular set of audio data. Registers may also be used to determine whether or not to allow particular PES or ES audio data to be sent to memory via bus mastering. For example, an AUDIO_ENABLE_PES_OUT register may be used to disable bus mastering of PES audio data. An AUDIO_ENABLE_ES_OUT register may be used to disable bus mastering of ES audio data. ES data is related to data found in PES audio data. In one embodiment, ES data is generated from PES audio data by converting the packetized PES audio data into an ES bit-stream, such as through a parallel to serial bit-stream converter, such as I2S formatter 570 (FIG. 5). In one embodiment, the registers used to configure operations within audio parser 600, such as registers 692-696, are part of a collection of registers, such as registers 690. An application program may be used to apply values to registers 690 for configuring the operations of audio parser 600. Other registers may also be included in registers 690, such as those described in reference to FIG. 11.

Referring now to FIG. 7, table illustrating registers for monitoring data related to processed transport packet fields are shown, according to one embodiment of the present invention. The registers provide reference to the results of data processed through the various data stream processors, such as a transport packet framer, transport packet parser, a transport stream adaptation field parser, or a video PES parser.

A TD_TP_HEADER register may be used to provide information regarding a current portion of a transport packet being parsed. For example, a TPH4 field is set to '0' when the start of a particular transport packet is received, and set to the value of the fourth byte after the fourth byte of the transport packet header is parsed. Accordingly, TPH3 and TPH2 fields are set to the values of the third and second byte of the header, respectively. TPH1 is set to the packet start code after the first byte of the transport packet header is parsed.

A TD_AF register may be used to provide information related to the parsing of adaptation field data. For example, an AF_LEN field is set to the length of the currently parsed adaptation field. In one embodiment, the length is determined through an adaptation field length syntax indicator found in the parsed adaptation field of the transport packet. An AF-FLAGS field provides the value related to the second byte of the adaptation field.

A TD_AF_EXT register may be used to provide information corresponding to extension data included in an adaptation field of a particular transport packet. For example, an AF_EXT_LEN field provides the length of the extension data in a particular adaptation field.

A TD_PES register may be used to provide information related to parsed PES data. A PES_STEAM_ID field may be used to provide a stream ID value extracted from a PES packet currently being parsed. A PES_HEADER_DATA_LEN field may be used to provide the length of a PES header related to a PES packet being parsed. A TD_PES_EXT register may be used to provide information related to extension data provided with PES data being parsed. For example, a PES_EXT_FIELD_LEN field indicates the length of the PES packet extension data bit-field.

Referring now to FIG. 8, a table illustrating fields of a register for providing the status of various data stream parsers is shown, according to one embodiment of the present invention. TD_PEEK register includes fields to provide status of the data stream parsers, such as a transport packet parser, an adaptation field parser and a PES parser. For example TP_PARSED, AF_PARSED and PES_PARSED fields indicate when a transport packet header, adaptation field or a PES packet has been parsed, respectively. In one embodiment, a TP_STATUS field includes 3-bits for providing the status of the transport packet parser. The status may indicate no errors, error due to a received scrambled transport packet, an illegal adaptation field flag, a duplicate transport packet received, an illegal adaptation field payload length or an illegal adaptation field private data length. In one embodiment, when an error id identified, the current transport packet is dropped.

Referring now to FIG. 9, a table illustrating fields of a register for configuring options related to the processing of program clock references is shown, according to one embodiment of the present invention. A TD_PCR_PID_CNTL register may be used to provide information regarding PCR values or control for configuring the processing of PCR values. For example, a PCR_PID field may be used to identify a PID value of a transport stream used to determine a stream time, through an extracted program clock reference. A FORCE_PCR_LOAD field may be used for controlling a process of loading a current program clock reference value, wherein a '0' indicates not to load a next PCR value into an STC counter and a value of '1' indicates to load the next PCR into the STC counter. A ROUTE_PCR_PACKET field is used to control the routing of PCR packets, wherein a value of '0' indicates to hardware to execute a PCR process, and a value of '1' indicates to hardware to route a packet, with a PID different than a video or audio PID, to a memory queue.

Referring now to FIG. 10, a table illustrating registers for configuring and monitoring status related to state machines associated with data stream parsers. A TD_SM_CNTL register provides configuration options regarding state machine operations. A VIDEO_AUDIO_SWITCH field allows monitoring of either a video PES parser, or an audio parser.

A TD_SM register may be used to monitor the status of various state machines used within a transport stream demultiplexer core. A FRAMER_STATE field provides information regarding a current operational state of a transport stream framer. States of a state machine used to dictate operations of the transport stream framer are described in reference to pending application Ser. No. 09/490,350, which has been incorporated by reference.

A TPHP_STATE field provides reference to the current state of operation of a transport packet header parser (TPHP). A value of '0' for TPHP_STATE indicates an IDLE state, in which the TPHP is disabled. A value of '1' indicates a TPHDR0 state in which the TPHP is currently parsing a first byte out of four (generally associated with a start code). A value of '2' indicates a TPHDR1 state in which the TPHP is currently parsing a second byte out of four (generally associated with a payload unit start indicator and a PID value). Values of '3'-'9' indicates states as described in the table for TD_SM, wherein a TPHDR2 state indicates the TPHP is parsing a third byte out of four (associated with the PID value). A TPHDR3 state indicates the TPHP is parsing a fourth byte out of four (generally associated with a transport scrambling control value, adaptation field control and continuity counter values). An AF state indicates the TPHP is enabling an adaptation field parser and disengaging operation. A PES state indicates the TPHP is enabling a PES packet parser and disengaging operation. An AF_PCR_ONLY state indicates the TPHP is enabling extraction of PCR samples and disengaging operation. An AF_PCR_ROUTE state indicates the TPHP is enabling extraction of PCR sample and enabling full transport packet routing. A FULL_PACKET_ROUTE state indicates the TPHP is enabling full transport packet routing.

An AFP_STATE field provides information regarding operational states of a TSAFP, according to one embodiment of the present invention. A value of '0' indicates an IDLE state in which the TSAFP is disengaged. A value of '1' indicates an AF_LEN_EXTRACT state in which the TSAFP is performing extraction of an adaptation field length value from a transport stream packet. Values of '2' to '10' indicate states as described for the AFP_STATE field, wherein an AF_FLAGS_EXTRACT state indicates the TSAFP is performing extraction of flag values from the adaptation field of a current transport packet. A PCR_EXTRACT state indicates the TSAFP is performing extraction of a PCR sample. An OPCR_SKIP state indicates the TSAFP is skipping over original PCR (OPCR) sample. A SPLICE_CNTDWN_EXTRACT state indicates the TSAFP is performing extraction of a splice countdown value from a current transport packet. A PRIVATE_DATA_LEN_EXTRACT state indicates the TSAFP is performing extraction of a private data length value from a current transport packet. A PRIVATE_DATA_EXTRACT state indicates the TSAFP is performing extraction of a private data value. An AF_EXT_LEN_EXTRACT state indicates the TSAFP is performing extraction of an extension data length value. An AF_EXT_SKIP state indicates the TSAFP is skipping over extension data associated with the current transport packet. A STUFFING_SKIP state indicates the TSAFP is skipping over stuffing data associated with the current transport packet.

A PESP_STATE field provides reference to current operational states of a video PES parser (PESP). In one embodiment, a value of '0' in the PESP_STATE field indicates an IDLE state in which the PESP is disabled. Values of '1' to '25' indicate states of the PESP, according to one embodiment of the present invention, and wherein a PESHDR0 state indicates the PESP is parsing a first byte of the current transport packet. Accordingly, states PESHDR1-PESHDR8indicate states of the PESP in which the PESP is parsing the second through the ninth byte of the current transport packet, respectively.

A PTSDTS_EXTRACT state indicates the PESP is performing extraction of a PTS bit-field. An ESCR_EXTRACT state indicates the PESP is performing extraction of an ESCR syntax element. An ESRATE_EXTRACT state indicates the PESP is performing extraction of an ES rate syntax element. A DSM_EXTRACT state indicates the PESP is performing extraction of a DSM trick mode byte. An ADDCOPY_EXTRACT state indicates the PESP is performing extraction of an additional copy info syntax element. A PES_CRC_EXTRACT state indicates the PESP is performing extraction of a previous 16-bit PES-packet cyclic redundancy code (CRC) value. A PES_EXT_EXTRACT state indicates the PESP is performing extraction of PES extension data flags. A PES_PRIVATE_DATA_EXTRACT state indicates the PESP is performing extraction of 16 private data bytes.

A PACK_HEADER_FIELD_EXTRACT state indicates the PESP is performing extraction of a pack field length value. A PACK_HEADER_SKIP state indicates the PESP is currently skipping over pack header values. A PPSC_EXTRACT state indicates the PESP is performing extraction of a program packet sequence counter identifier. A PSTD_BUFFER_EXTRACT state indicates the PESP is performing extraction of a P_STD buffer scale value and a P_STD buffer size value. A PES_EXT2_EXTRACT state indicates the PESP is performing extraction of a PES extension field length value. A PES_EXT2_SKIP state indicates the PESP is skipping over reserved data associated with PES extension data. A STUFFING_EXTRACT state indicates the PESP is skipping over stuffing bytes associated with a PES payload. A PAYLOAD_EXTRACT state indicates the PESP is performing extraction of a set of payload data (generally associated with elementary stream data).

CC STATE and PCRCC_STATE fields identify separate states of state machines associated with continuity counter verifiers. Continuity counter values are provided within transport packets (as shown in Prior-art FIG. 1). Multiple packets may be sent associated with a single PID value. While the packets may be sent out of order, the continuity counter value provides the order associated with packets having a common PID. Separate states are described for a continuity counter verifier which functions over transport packets not carrying PCR information and a continuity counter verifier which functions over transport packets that do include PCR information.

A CC_STATE field provides reference to current operational states of the continuity counter verifier which functions over transport packets not carrying PCR information. A value of '0' for the CC_STATE field indicates a CC_IDLE state in which the continuity counter verifier is disabled. States corresponding to values of '1' to '5' indicate states as described in reference to the CC_STATE field, according to one embodiment of the present invention, wherein a CC_LOAD state indicates the continuity counter verifier is saving a current continuity counter value. A CC_INC state indicates the continuity counter verifier is incrementing a previously extracted continuity counter value. A CC_AF_LEN state indicates the continuity counter verifier is extracting an adaptation field length value. A CC_DSCNT_IND state indicates the continuity counter verifier is reloading a continuity counter due to continuity counter discontinuity.

A PCRCC_STATE field provides reference to current operational states of the continuity counter verifier which functions over transport packets carrying PCR information. For example, in one embodiment, a value of '0' indicates a PCRCC_IDLE state in which the continuity counter verifier associated with PCR transport packets (PCRCC) is disabled. Values of '1' to '5' indicate states of the PCRCC as provided in reference to the PCRCC_STATE field in the table, according to one embodiment, wherein a PCRCC_COMP state indicates the PCRCC is comparing extracted continuity counter values to expected continuity counter values. A PCRCC_LOAD state indicates the PCRCC is saving a current continuity counter value. A PCRCC_INC state indicates the PCRCC is incrementing an extracted continuity counter value. A PCRCC_AF_LEN state indicates the PCRCC is extracting an adaptation field length value. A PCRCC_DSCNT_IND state indicates the PCRCC is discarding discontinuity on continuity counts due to PCR discontinuity. It should be appreciated that other states regarding the functional components of a transport stream demultiplexer, such as the framer, the TPHP, the TSAFP, the PESP, the non-PCR continuity counter verifier and the PCRCC may be included without departing from the scope of the present invention.

Referring now to FIG. 11, a table illustrating registers for configuring options related to an audio parser is shown, according to one embodiment of the present invention. A TD_AUDIO_CNTL register provides a first set of configuration options associated with the audio parser and a TD_AUDIO_CNTL2 register provides a second set of configuration options associated with the audio parser.

An AUDIO_PID field may be used to identify a particular PID value of a transport packet associated with an audio stream. As previously discussed, the audio parser may use the value of the AUDIO_PID field to determine which transport packets to process. A value may be asserted to an AUDIO_ENABLE_PARSING field for disabling audio parser operations. In one embodiment, a '1' written to AUDIO_ENABLE PARSING is used to enable the audio parser and a value of '0' is used to disable the audio parser.

In one embodiment, an AUDIO_BUFFER_INDEX field may be used to identify one of sixty-four buffers in system memory where audio data may be routed. An AUDIO_START_FROM_PUSI field may be used to indicate whether the audio parser starts form a current transport packet or from a transport packet which includes a payload unit start indicator set to a value of '1'. An AUDIO_PROCESS_STREAM_ID field may be used for disabling filtering to be performed based on a stream ID indicator. An AUDIO_ STREAM_ID field may indicate a particular stream ID value to filter on. While particular transport packets may be flagged due to errors associated with the transport packet during processing, an IGNORE_AUDIO_TEI may be set to configure the audio parser to ignore all error flagged transport streams.

A TD_AUDIO_PID_CNTL2 register may also be used in configuration of the audio parser. An AUDIO_ENABLE_PES_OUT field may be used for controlling the bus-mastered output of processed audio PES data to memory. For example, a value of '1' may be used to enable bus mastering of PES packets to memory, while a '0' disables the bus-mastering of PES packets to memory. An AUDIO_ENABLE_ES_OUT field may be used for controlling the bus-mastered output of processed audio ES data to memory. A value of '1' may be used to enable bus mastering of ES packets to memory, while a '0' disables the bus-mastering of ES packets to memory. A MASK_I2S_REQ field may be used for enabling or disabling output of the audio data from the audio parser to an external audio decoder.

Referring now to FIG. 12, a table illustrating various control and status settings related to system interrupts is shown, according to one embodiment of the present invention. A GEN_INT_CNTL register provides access to control the use of particular interrupts. A GEN_INT_STATUS register may be used to identify the status of particular interrupts.

In one embodiment, an I2S_FIFO_DATA_REQ_INT_EN field, of the GEN_INT_CNTL register, may be sued to enable or disable interrupts that are generated when a request for more bit-stream data occurs from an external hardware audio decoder. An application may be used to trigger an audio decoder to process a particular stream of audio data. The request for the audio data associated with the stream, generated by the audio decoder, may be used to generate an interrupt to processing components, such as an audio parser to generate the requested data. A CHIP_INT_EN field may be used to enable or disable global interrupts associated with the processing system.

In one embodiment, an I2S_FIFO_DATA_REQ_INT_AK (W) field, of the GEN_INT_STATUS register, may be used for clearing an I2S interrupt request. I2S_DATA_REQ_INT_AK field indicates the interrupt has occurred and is a method of acknowledging the interrupt by setting the value of the field to a '1', clearing the interrupt. An I2S_FIFO_DATA_REQ_INT field provides status of the I2S interrupt request. A field value of '1' indicates the I2S interrupt request event has occurred and is interrupting if the associated interrupt is enabled, such as through the I2S_FIFO_DATA REQ_INT_EN field.

The systems described herein may be part of an information handling system. The term "information handling system" refers to any system that is capable of processing information or transferring information from one source to another. An information handling system may be a single device, such as a computer, a personal digital assistant (PDA), a hand held computing device, a cable set-top box, an Internet capable device, such as a cellular phone, and the like. Alternatively, an information handling system may refer to a collection of such devices. It should be appreciated that while components of the system have been describes in reference to video and audio processing components, the present invention may be practiced using other types of system components. It should be appreciated that the system described herein has the advantage of providing improved parsing of transport streams containing audio data.

In the preceding detailed description of the embodiments, reference has been made to the accompanying drawings which form a part thereof, and in which is shown by way of illustration specific embodiments in which the invention may be practiced. These embodiments are described in sufficient detail to enable those skilled in the art to practice the invention, and it is to be understood that other embodiments may be utilized and that logical, mechanical and electrical changes may be made without departing from the spirit or scope of the invention. To avoid detail not necessary to enable those skilled in the art to practice the invention, the description may omit certain information known to those skilled in the art. Furthermore, many other varied embodiments that incorporate the teachings of the invention may be easily constructed by those skilled in the art. Accordingly, the present invention is not intended to be limited to the specific form set forth herein, but on the contrary, it is intended to cover such alternatives, modifications, and equivalents, as can be reasonably included within the spirit and scope of the invention. The preceding detailed description is, therefore, not to be taken in a limiting sense, and the scope of the present invention is defined only by the appended claims.

What is claimed is:

1. A method comprising:

receiving one or more transport packets;

identifying a transport packet as containing audio stream data;

comparing a value of a first field in the transport packet to a value of a first field register to determine a first outcome in response to identifying the transport packet as containing audio stream data; and determining whether to enable audio stream data related to the transport packet to be received by a system or to discard the transport packet, based at least in part on the first outcome.

2. The method as in claim 1, wherein the system is a decoding system and the method further includes providing the audio stream data related to the transport packet to a decoding system.

3. The method as in claim 2, wherein the audio stream data includes Packetized Elementary Stream (PES) audio data.

4. The method as in claim 2, wherein the decoding system detects an audio stream data property through a stream indicator included in the audio stream data.

5. The method as in claim 4, wherein the stream indicator includes one or more start codes.

6. The method as in claim 4, wherein the stream indicator includes one or more presentation time stamps.

7. The method as in claim 2, wherein the audio decoding system includes one of a Moving Pictures Experts Group (MPEG) audio decoder, an Audio Compression-3 (AC-3) audio decoder, an Advanced Audio Coding (AAC) audio decoder or a Digital Theatre Systems (DTS) audio decoder.

8. The method as in claim 2, wherein the decoding system includes an Inter-Integrated Circuit Sound (I2S) formatter.

9. The method as in claim 2, wherein the decoding system is capable of generating an interrupt to control receiving the audio data related to the transport packet.

10. The method as in claim 9, wherein the interrupt is initiated through an application.

11. The method as in claim 1, wherein the first field indicates an audio type.

12. The method as in claim 1, wherein the first field indicates a sampling rate.

13. The method as in claim 1, further including providing audio data related to the transport packet to memory.

14. The method as in claim 13, wherein providing audio data related to the transport packet to memory includes bus-mastering the audio data related to the transport packet to memory.

15. A system for parsing audio data associated with a transport packet of a packetized elementary stream, the system comprising:

a data bus having a predetermined number of nodes for transmitting a plurality of data words;

a transport packet parser having:

a storage location having an output coupled to the data bus, the storage location to store a value identifying a first data word, wherein the first data word has a first audio packet indicator;

a first comparator having a first input coupled to the output of the storage location and an output coupled to an audio parser;

said audio parser having an enable input coupled to the first comparator, the audio parser further includes:

a first storage location having an output coupled to the data bus, the first storage location to store a first value representing a valid data word having the first audio packet indicator;

a second storage location for storing a second value representing a second audio packet indicator;

a first audio packet filter for analyzing the first value with respect to the second value; and a second comparator having an input coupled to the output of the first storage location of said audio parser and an output; and an audio decoding system having an input coupled to said output of the second comparator, said audio decoding system including an elementary stream formatter for processing audio data associated with the data word into an elementary stream;

wherein the audio decoding system is enabled to process said audio data or to discard said audio data associated with the data word based at least in part on said output of the second comparator.

16. The system as in claim 15, wherein said comparable audio packet indicator includes a stream identifier.

17. The system as in claim 15, further including a bus-master controller.

18. The system as in claim 17, wherein said bus-master controller is to bus-master a representative of said first data word from said audio parser to memory.

19. The method as in claim 15, wherein said audio decoder processes a representative of the first data word from said audio parser into audio data.

20. The system as in claim 19, wherein said decoding system is capable of identifying an audio property of the representative of the first data word through a second audio packet indicator.

21. The system as in claim 20, wherein said audio property includes an audio type.

22. The system as in claim 20, wherein said audio property includes a sampling rate.

23. The system as in claim 20, wherein said second audio packet indicator includes one or more start codes.

24. The system as in claim 20, wherein said second audio packet indicator includes a presentation timestamp.

25. The method as in claim 15, wherein said audio decoding system includes an I2S formatter.

26. The method as in claim 15, wherein said audio decoding system is capable of generating an interrupt in response to a request for a particular portion of audio data to be processed by said audio parser.

27. The method as in claim 26, wherein said interrupt is generated through an application.

28. The system as in claim 15, wherein said audio decoding system is represented through hardware.

29. The system as in claim 15, wherein said audio decoding system includes one of a Moving Pictures Experts Group (MPEG) audio decoder, an Audio Compression-3 (AC-3) audio decoder, an Advanced Audio Coding (AAC) audio decoder or a Digital Theatre Systems (DTS) audio decoder.

30. A system comprising:

means for receiving one or more transport packets;

means for identifying a transport packet as containing audio stream data; and means for determining whether to enable audio stream data related to the transport packet to be received by a system or to discard the transport packet based at least in part on a comparison of a value of a first field in the transport packet to a value of a first field register, wherein the comparison is in response to identifying the transport packet as containing audio stream data.

* * * * *